US009988178B2

(12) United States Patent
Apps

(10) Patent No.: US 9,988,178 B2
(45) Date of Patent: Jun. 5, 2018

(54) PLASTIC BEER KEG

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 575 days.

(21) Appl. No.: 13/292,142

(22) Filed: Nov. 9, 2011

(65) Prior Publication Data

US 2012/0111874 A1 May 10, 2012

Related U.S. Application Data

(60) Provisional application No. 61/411,791, filed on Nov. 9, 2010.

(51) Int. Cl.

| | |
|---|---|
| ***B65D 8/02*** | (2006.01) |
| ***B65D 43/02*** | (2006.01) |
| ***B65D 77/04*** | (2006.01) |
| ***B67D 1/08*** | (2006.01) |
| ***B67D 1/12*** | (2006.01) |

(52) U.S. Cl.

CPC ..... *B65D 11/08* (2013.01); *B65D 43/0212* (2013.01); *B65D 43/0231* (2013.01); *B65D 77/0486* (2013.01); *B67D 1/0832* (2013.01); *B67D 1/125* (2013.01); *B65D 2213/00* (2013.01); *B65D 2543/0074* (2013.01); *B65D 2543/00083* (2013.01); *B65D 2543/00296* (2013.01); *B65D 2543/00407* (2013.01); *B65D 2543/00537* (2013.01); *B65D 2543/00657* (2013.01); *B65D 2543/00694* (2013.01); *B65D 2543/00805* (2013.01)

(58) Field of Classification Search

USPC ..... 220/592.19, 293, 601, 298

See application file for complete search history.

(56) References Cited

U.S. PATENT DOCUMENTS

| | | | | |
|---|---|---|---|---|
| 3,140,007 | A * | 7/1964 | Nettleship | 206/508 |
| 3,825,145 | A * | 7/1974 | Reynolds | 220/661 |
| 3,827,515 | A | 8/1974 | Reynolds | |
| 3,827,595 | A * | 8/1974 | Reynolds | 220/661 |
| 3,908,871 | A * | 9/1975 | Gottwald | 222/400.7 |

(Continued)

FOREIGN PATENT DOCUMENTS

| | | |
|---|---|---|
| DE | 16 11 991 A1 | 2/1971 |
| EP | 1095897 | 5/2001 |

(Continued)

OTHER PUBLICATIONS

European Search Report for EP Application No. 11188503.4, dated Feb. 15, 2012.

(Continued)

*Primary Examiner* — Fenn C Mathew

(74) *Attorney, Agent, or Firm* — Carlson, Gaskey & Olds PC

(57) ABSTRACT

A plastic keg includes a liner including a neck portion and a body portion. A lid having an opening is disposed at least partially over the liner. The liner is disposed in an outer container having a wall with at least one locking rib projecting therefrom. The locking rib angles downward and the lid secured to the outer container by the at least one locking rib. Optionally, a locking ring securing the neck portion of the liner to the lid may be configured to release the liner when the filled keg is dropped.

16 Claims, 8 Drawing Sheets

(56) References Cited

U.S. PATENT DOCUMENTS

| | | | | | |
|---|---|---|---|---|---|
| 3,952,904 | A * | 4/1976 | Verlinden | 220/4.05 |
| 4,027,777 | A | 6/1977 | Blanke, Jr. | |
| 4,032,047 | A * | 6/1977 | Wilson | 222/183 |
| 4,482,067 | A * | 11/1984 | Saito et al. | 215/386 |
| 4,491,247 | A * | 1/1985 | Nitchman et al. | 222/131 |
| 4,519,219 | A * | 5/1985 | Prepodnik et al. | 62/457.1 |
| 4,531,656 | A * | 7/1985 | Nitchman et al. | 222/131 |
| 4,867,348 | A * | 9/1989 | Dorfman | 222/173 |
| 5,129,534 | A * | 7/1992 | Dunn | 220/4.33 |
| 5,267,669 | A * | 12/1993 | Dixon et al. | 222/173 |
| 5,597,085 | A * | 1/1997 | Rauworth et al. | 220/581 |
| 5,897,016 | A * | 4/1999 | Wheaton | 220/581 |
| 6,196,277 | B1 * | 3/2001 | Till et al. | 141/48 |
| 6,260,823 | B1 * | 7/2001 | Weber | 251/351 |
| 6,308,858 | B1 * | 10/2001 | Koefelda | 220/608 |
| 6,343,916 | B1 * | 2/2002 | Bougamont et al. | 417/569 |
| 6,415,959 | B1 * | 7/2002 | Bougamont et al. | 222/159 |
| 6,626,314 | B1 * | 9/2003 | McHenry et al. | 220/254.2 |
| 6,663,858 | B1 | 12/2003 | Field | |
| 6,666,358 | B1 * | 12/2003 | Field | 222/400.7 |
| 6,748,789 | B2 * | 6/2004 | Turner et al. | 72/379.4 |
| 6,751,981 | B1 * | 6/2004 | Burnette | 62/457.2 |
| 6,805,267 | B2 * | 10/2004 | Bougamont | 222/633 |
| 7,134,578 | B2 * | 11/2006 | Bougamont | 222/321.9 |
| 7,174,762 | B2 * | 2/2007 | Turner et al. | 72/348 |
| 7,455,082 | B2 * | 11/2008 | Monzel | 141/18 |
| 7,546,935 | B2 * | 6/2009 | Wheaton | 222/400.7 |
| 7,819,286 | B2 * | 10/2010 | Antheil et al. | 222/105 |
| 2004/0026461 | A1 * | 2/2004 | Bougamont et al. | 222/321.9 |
| 2006/0049213 | A1 * | 3/2006 | Wheaton | 222/400.7 |
| 2008/0251542 | A1 * | 10/2008 | Rossignol | 222/380 |
| 2008/0277001 | A1 * | 11/2008 | Wheaton | 137/637 |
| 2009/0206505 | A1 * | 8/2009 | Monzel et al. | 264/101 |
| 2009/0320264 | A1 * | 12/2009 | Berger et al. | 29/428 |
| 2010/0077790 | A1 * | 4/2010 | Apps | 62/372 |
| 2010/0264140 | A1 | 10/2010 | Apps | |
| 2011/0017737 | A1 * | 1/2011 | Apps | 220/254.1 |
| 2011/0180535 | A1 * | 7/2011 | Apps | 220/254.1 |

FOREIGN PATENT DOCUMENTS

| | | |
|---|---|---|
| EP | 1270499 | 1/2003 |
| EP | 1947029 | 7/2008 |
| EP | 2281753 | 2/2011 |
| EP | 2 368 809 A1 | 9/2011 |
| FR | 2665688 | 2/1992 |
| GB | 437295 | 10/1935 |
| GB | 2182319 | 5/1987 |
| GB | 2188040 | 9/1987 |
| GB | 2209740 | 5/1989 |
| GB | 2283967 | 5/1995 |
| WO | 9112196 | 8/1991 |
| WO | 99 39990 | 8/1999 |
| WO | 2004063087 | 7/2004 |
| WO | 2006110948 | 10/2006 |
| WO | 2008013819 | 1/2008 |
| WO | 2008083782 | 7/2008 |
| WO | 2010 120347 | 10/2010 |

OTHER PUBLICATIONS

European Search Report for EP Application No. 11188503.4, dated May 9, 2012.
Appeal Brief filed with the USPTO dated Jul. 15, 2013 for U.S. Appl. No. 12/243,742.
Examiners Answer dated Oct. 28, 2013 for U.S. Appl. No. 12/243,742.
Reply Brief filed with the USPTO dated Dec. 27, 2013 for U.S. Appl. No. 12/243,742.
Appeal Brief filed with the USPTO dated Jun. 19, 2013 for U.S. Appl. No. 12/693,831.
Examiners Answer dated Oct. 24, 2013 for U.S. Appl. No. 12/693,831.
Reply Brief filed with the USPTO dated Dec. 24, 2013 for U.S. Appl. No. 12/693,831.
Final Office Action dated Feb. 28, 2014 for U.S. Appl. No. 12/509,819.
Non-Final Office Action dated Apr. 21, 2014 for U.S. Appl. No. 13/292,142.
Final Office Action dated Dec. 13, 2013 for U.S. Appl. No. 13/735,323.
Advisory Action dated Mar. 28, 2014 for U.S. Appl. No. 13/735,323.
Response to Advisory Action filed with the USPTO dated Apr. 16, 2014 for U.S. Appl. No. 13/735,323.
Response to Final Office Action filed with the USPTO dated Feb. 13, 2014 for U.S. Appl. No. 13/735,323.
Response to Non-Final Office Action filed with the USPTO dated Apr. 28, 2014 for U.S. Appl. No. 12/509,819.
Response to Final Office Action filed with the USPTO dated Jul. 28, 2014 for U.S. Appl. No. 12/509,819.
Advisory Action dated Jun. 13, 2014 for U.S. Appl. No. 13/292,141.
Amendment with RCE filed with the USPTO dated Jul. 24, 2014 for U.S. Appl. No. 13/292,141.
Response to Final Office Action filed with the USPTO dated May 27, 2014 for U.S. Appl. No. 13/292,141.
Final Office Action dated Mar. 24, 2014 for U.S. Appl. No. 13/292,141.

* cited by examiner

PLASTIC BEER KEG

This application claims priority to U.S. Provisional Application Ser. No. 61/411,791, filed Nov. 9, 2010.

BACKGROUND

The present invention relates to a plastic container for liquids, particularly beverages such as beer.

Most current beer kegs include a steel body with a valve in the top for both filling the keg and for accessing the contents. The steel kegs are reusable. Empty kegs are returned and then washed and refilled in an automated process. The steel kegs are inverted, such that the valve is at the bottom of the keg to facilitate draining during cleaning. The interior of the body of the keg is washed by spraying cleansing liquids through the valve. The cleansing liquids wash the inner surface of the body of the keg and then drain downward through the valve. The kegs are typically then filled in the inverted position through the valve at the bottom of the keg. Throughout the automated process, a cylinder clamps the body of the keg with a high force (between 200 and 300 lb.) to hold the keg in place while the washing and filling heads connect to the valve at the bottom of the keg.

There are several problems with the use of steel kegs. First, they are fairly heavy, even when empty. Second, they are expensive and are not always returned by the user. If a deposit is charged to the user to ensure the return of the keg, this may discourage the user from choosing to purchase beer by the keg in the first place. However, if the deposit is too low, it is possible that the value of the steel in the keg exceeds the amount of the deposit, thus contributing to some kegs not being returned.

SUMMARY

According to one feature of the present invention, a plastic keg includes a liner including a neck portion and a body portion. A lid having an opening is disposed at least partially over the liner. The liner is disposed in an outer container having a wall with at least one locking rib projecting therefrom. The locking rib angles downward and the lid secured to the outer container by the at least one locking rib.

Optionally, the lid can be snapped onto the locking rib or rotated to lock onto the locking rib. This can be accomplished by an angled surface on at least one of the locking rib and the shoulder of the lid that snaps under the locking rib.

In another feature of the present invention, which could be practiced independently of the others, a locking ring secures the liner to the lid, and the locking ring is configured to release the liner from the lid upon impact of the keg in a drop. This can be accomplished by molding the locking ring from a softer material, which flexes to release the liner on impact, or a more brittle locking ring or a locking ring with design-in stress concentrators, which breaks to release the liner on impact.

In an optional method for assembling a beer keg, the liner of the beer keg is filled with beer while the locking ring is securing the neck portion of the liner to the lid, but the locking ring is removed after filling and prior to shipping of the beer keg. The filled keg is shipped, sold and used without the locking ring. The locking ring may be reused in the filling of many kegs.

DETAILED DESCRIPTION OF THE PREFERRED EMBODIMENTS

Figure 1:
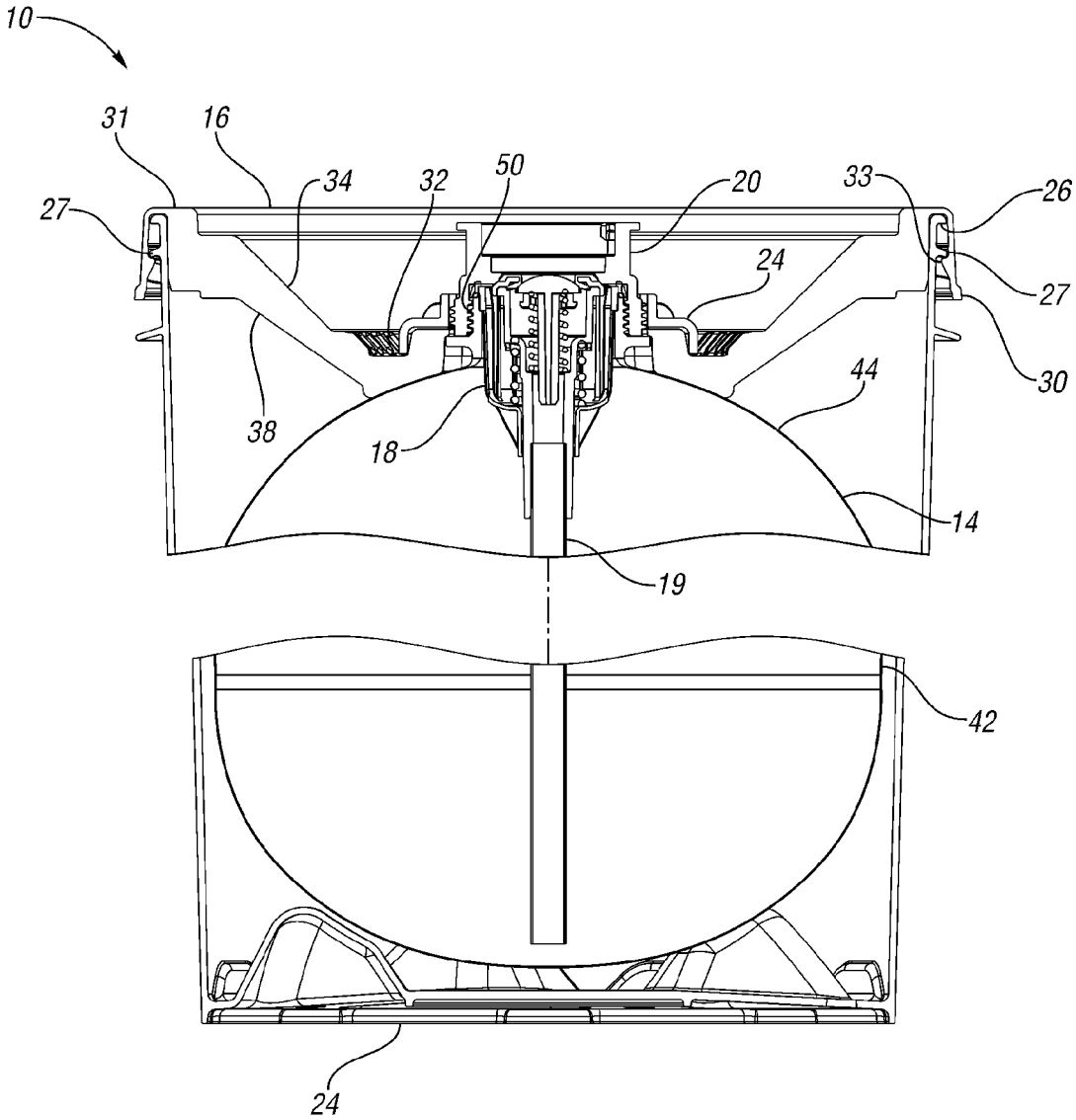
FIG. 1 is a section view of a plastic keg according to a first embodiment of the present invention.

FIG. 1 is a section view of an assembled plastic beer keg 10 according to one embodiment of the present invention. The plastic beer keg 10 generally includes an outer container 12 surrounding an inner liner 14, such as a PET bottle. A lid 16 is secured over an open end of the outer container 12 to retain the liner 14 within the interior of the outer container 12. A valve assembly 18 is retained in the mouth of the liner 14 by a retainer 20, which protrudes through the lid 16. A tube 19 extends from the valve assembly 18 to the bottom of the liner 14.

The outer container 12 includes a cylindrical outer wall 22 having an outwardly projecting lip 26 at an upper edge thereof. A plurality of locking ribs 27 (in this example, four) project outward from the cylindrical outer wall 22 below the lip 26.

The lid 16 includes a lip 30 extending downward from a generally horizontal, annular rim portion 31 extending about the periphery of the lid 16 and sealed over the lip 26 of the outer container 12. A plurality of inwardly-projecting shoulders 33 are formed about the inner periphery of the lip 30 of the lid 16 and are secured below the locking ribs 27 of the cylindrical outer wall 22.

The lid 16 further includes a lower annular wall 32 spaced below the upper edge of the outer container 12 and connected by a frustoconical wall 34 to the outer periphery of the lid 16. A plurality of radially extending ribs 38 reinforce the frustoconical wall 34. The retainer 20 projects through an opening through the center of the lid 16.

The liner 14 is a PET bottle or other suitable material having generally cylindrical side walls 42 and an upper shoulder portion 44 transitioning to a neck 50, which as shown, may be threaded.

The retainer 20 is secured to the neck 50 of the liner 14 in order to retain the valve assembly 18 within the neck 50. The retainer 20 is secured to the neck 50 of the liner 14 by a snap-fit or by threading that may lock in place when the threads bottom out. A fastener, in this case a locking ring 24, is secured to the retainer 20 to secure the retainer 20 to the lid 16. In this example, the locking ring 24 is threaded to the retainer 20 to prevent the retainer 20 from being removed downwardly through the opening in the lid 16.

In one embodiment, the locking ring 24 may be separately molded from the same type of material as the outer container 12, the lid 16, and the retainer 20. The outer container 12, the lid 16, and the retainer 20 may each be separately molded of HDPE, polypropylene or other suitable materials.

Alternatively, the locking ring 24 could be separately molded of a softer, more flexible material, such as low density polyethylene (LDPE). With a softer, more flexible locking ring 24, the locking ring 24 will release the neck 50 of the liner 14 if the keg 10 is dropped from a sufficient height. This may prevent neck 50 from breaking from the liner 14. However, the locking ring 24 still should be strong enough to hold the liner 14 as it is being filled by the automated filler equipment.

As another alternative, the locking ring 24 could be separately molded from a more rigid, more brittle material, such as a glass- or mineral-filled polyethylene or polypropylene, such as a 20% talc-filled polypropylene. Many other fillers or a foam additive could be used to make the material more brittle. Alternatively, or additionally, stress concentrators could be designed into the locking ring 24, such as notches along a break line. With a more brittle, locking ring 24, the locking ring 24 will break and release the neck 50 of the liner 14 if the keg 10 is dropped from a sufficient height. This may prevent neck 50 from breaking from the liner 14.

As another alternative, the locking ring 24 can be removed after the keg 10 is filled. The locking ring 24 is primarily to protect the liner 14 from the high clamping forces during filling with automated filling equipment, but the locking ring can damage the neck 50 of the liner 14 if the filled keg 10 is dropped. In this case, a ¼ turn locking ring 24 could be used for easy installation and removal. The locking ring 24 could even be installed right before filling, removed right after filling and reused repeatedly to fill a plurality of kegs 10. The locking ring 24 could still be made of the softer, more flexible material or the more rigid, more brittle material (as described above) in case kegs 10 are inadvertently shipped without removing the locking rings 24. Thus, in this method, the liner 14, valve assembly and retainer 20 are assembled into the outer container 12 and lid 16 with or without a locking ring 24. If automated filling equipment with high clamping forces is used and if the locking ring 24 was not shipped with the keg 10, the locking ring 24 is added just prior to filling. The keg 10 is filled in the inverted position, during which a high force may be exerted on the valve. The locking ring 24 transfers this force from the valve to the lid 16 and the outer container 12, not through the liner 14. The locking ring 24 is then removed and reused to fill additional kegs 10. The filled kegs 10 are then shipped without the locking rings 24.

Figure 3:
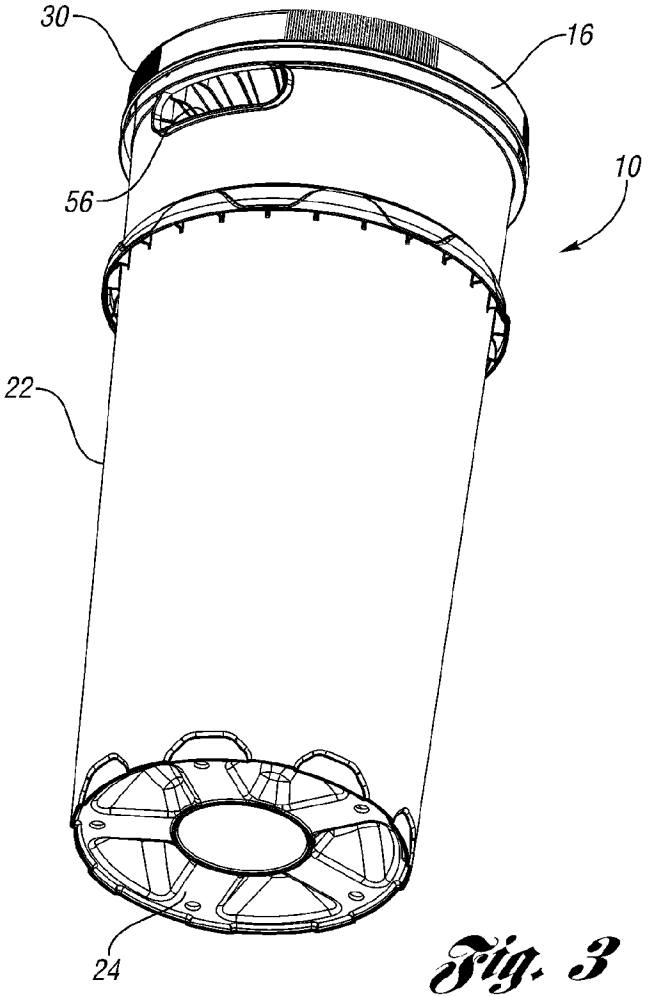
FIG. 3 is a bottom perspective view of the plastic keg.
Figure 2:
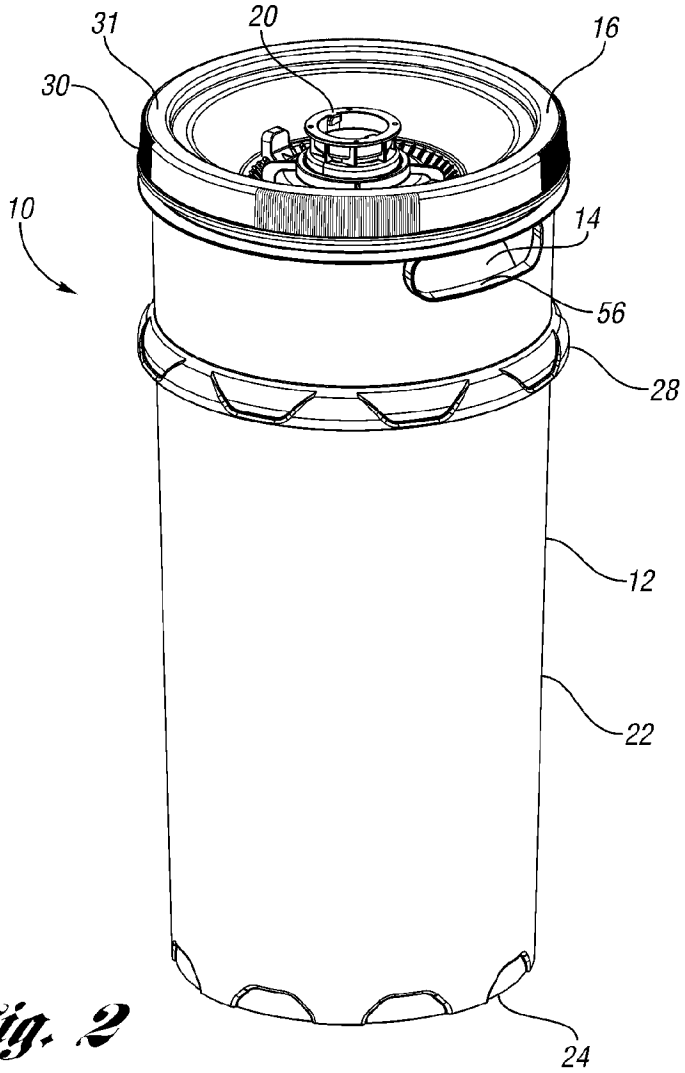
FIG. 2 is a perspective view of the plastic keg.

FIGS. 2 and 3 are exterior views of the keg 10 of FIG. 1. As shown, the wall 22 of the outer container 12 may include handle openings 56 (one shown, but another would be formed on the opposite side). A skirt 28 may extend around the periphery of the wall 22 to provide ease of handling.

Figure 5:
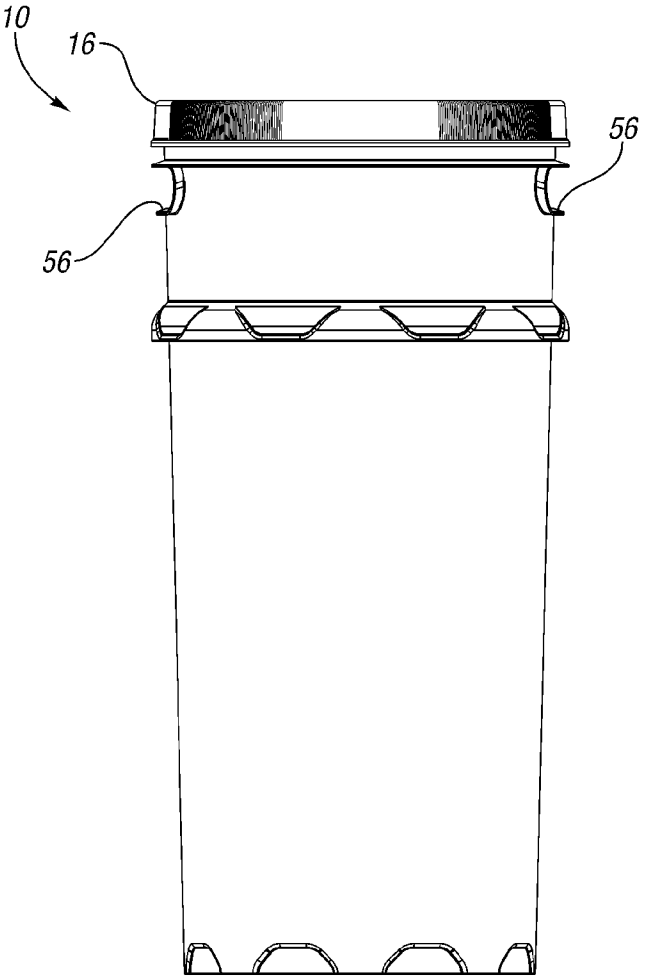
FIG. 5 is a second side view of the plastic keg.
Figure 4:
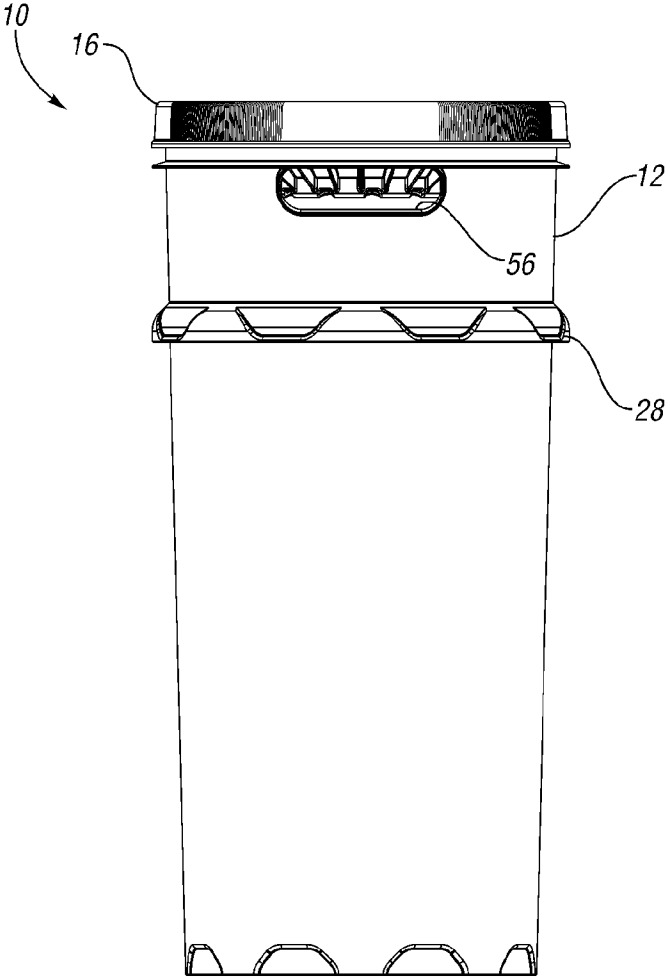
FIG. 4 is a first side view of the plastic keg.
Figure 7:
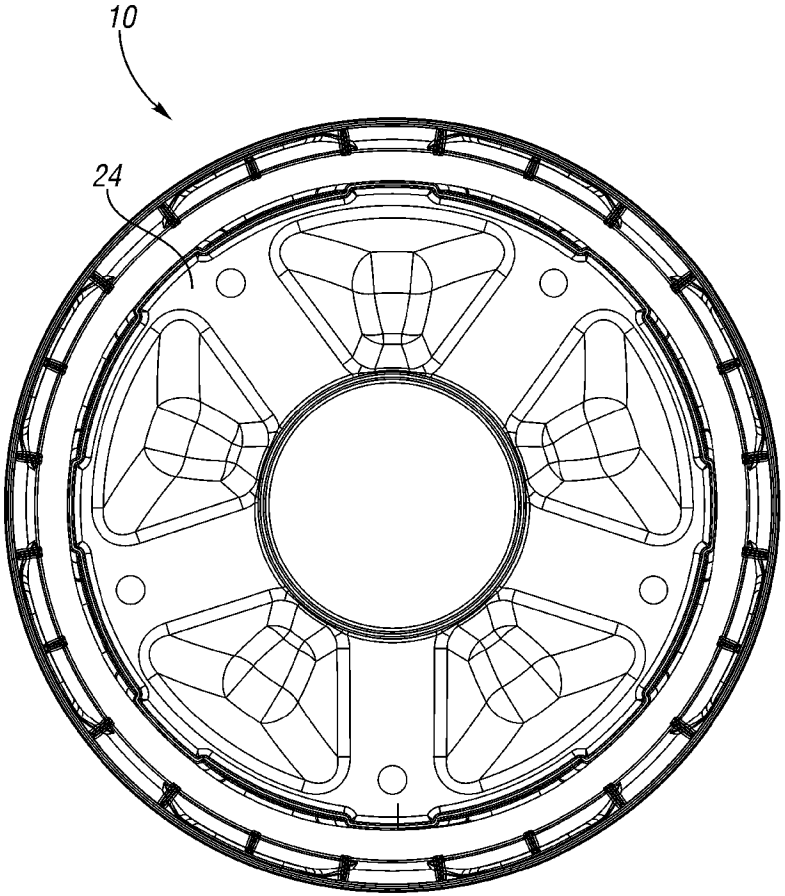
FIG. 7 is a bottom view of the plastic keg of FIG. 1.
Figure 6:
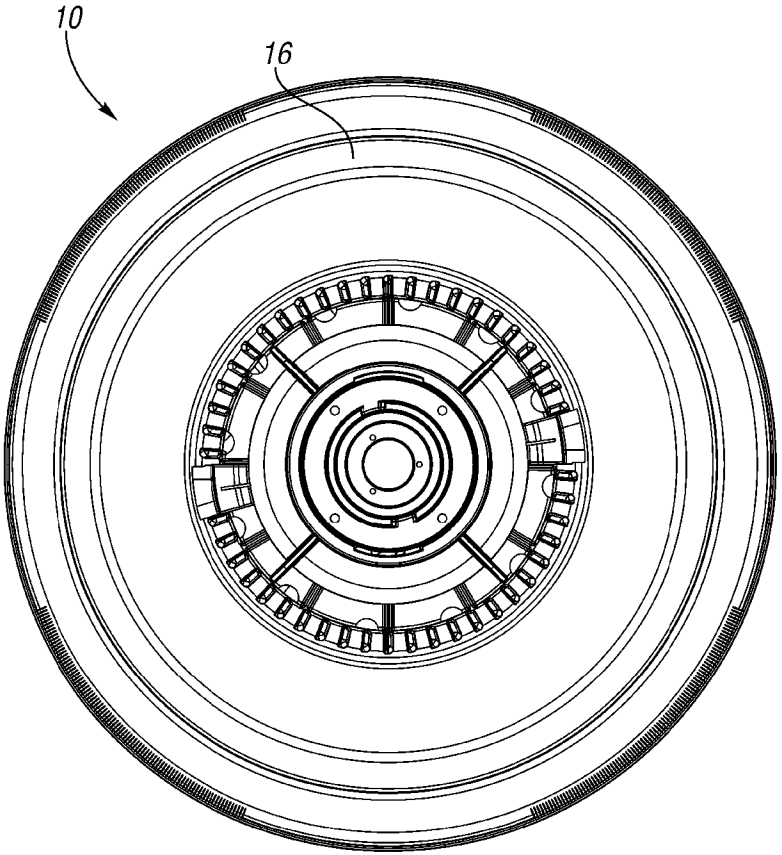
FIG. 6 is a top view of the plastic keg of FIG. 1.

FIGS. 4 and 5 are side views of the keg 10. FIGS. 6 and 7 are top and bottom views, respectively, of the keg 10.

Figure 9:
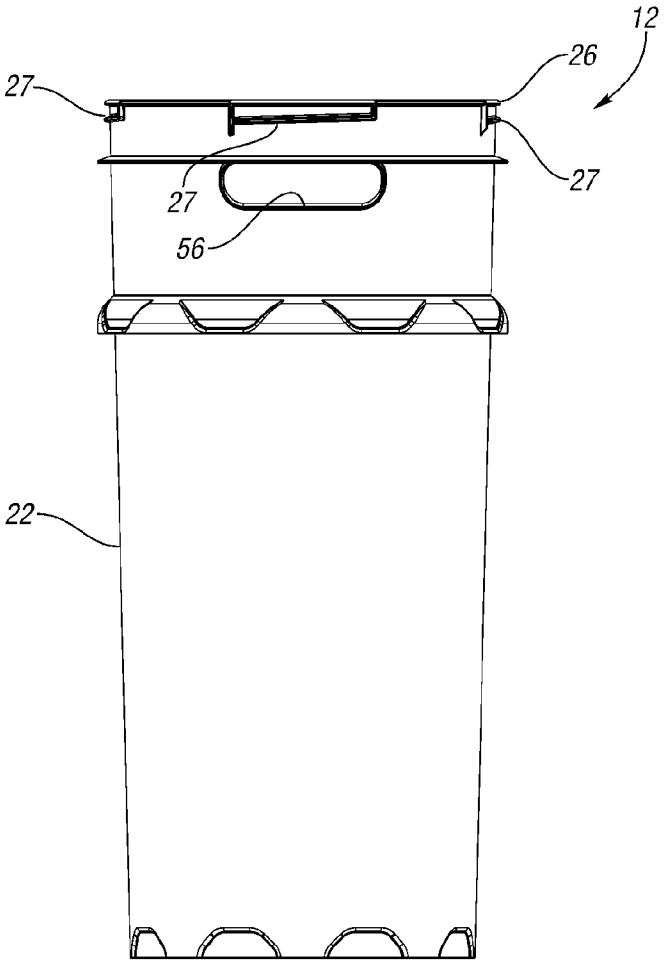
FIG. 9 is a second side view of the outer container.
Figure 8:
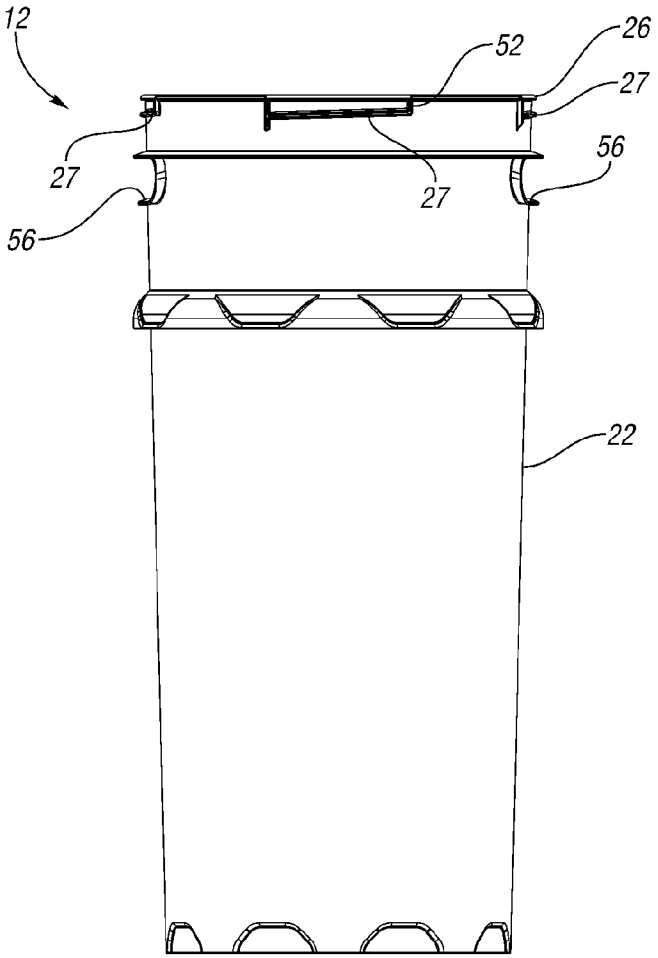
FIG. 8 is a first side view of the outer container.
Figure 10:
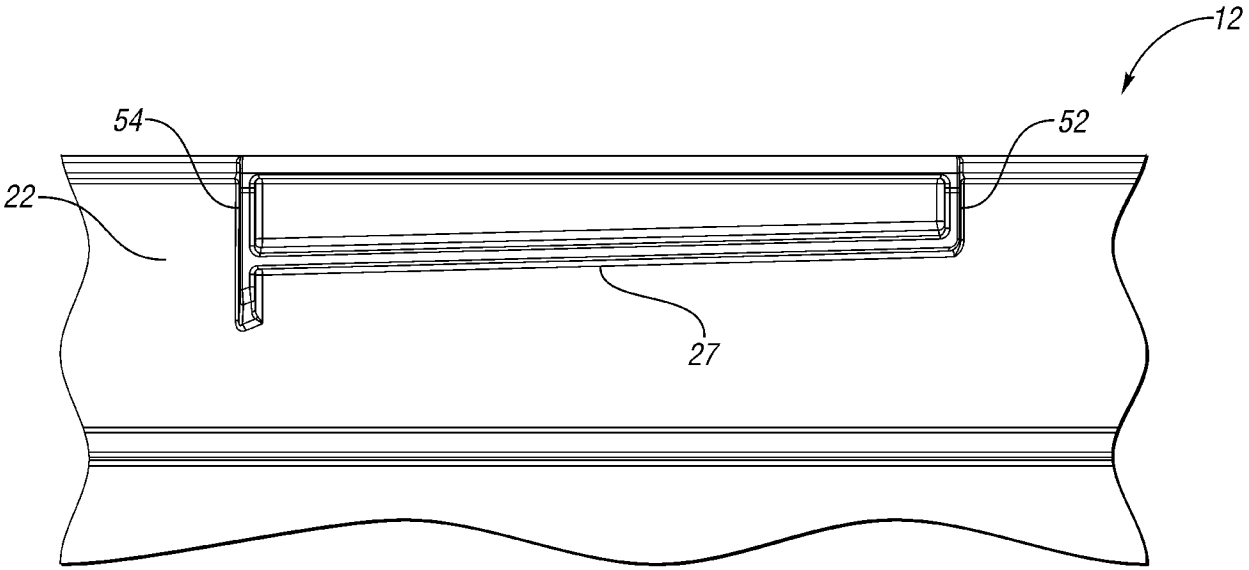
FIG. 10 is an enlarged view of the locking rib of FIG. 9.

FIGS. 8 and 9 are side views of the outer container 12. As shown, there are four locking ribs 27 disposed about the periphery of the outer container 12. FIG. 10 is an enlarged view of one of the locking ribs 27. As shown, the locking rib 27 angles downwardly between a leading rib 52 and a stop rib 54 that extends downward past the locking rib 27.

Figure 11:
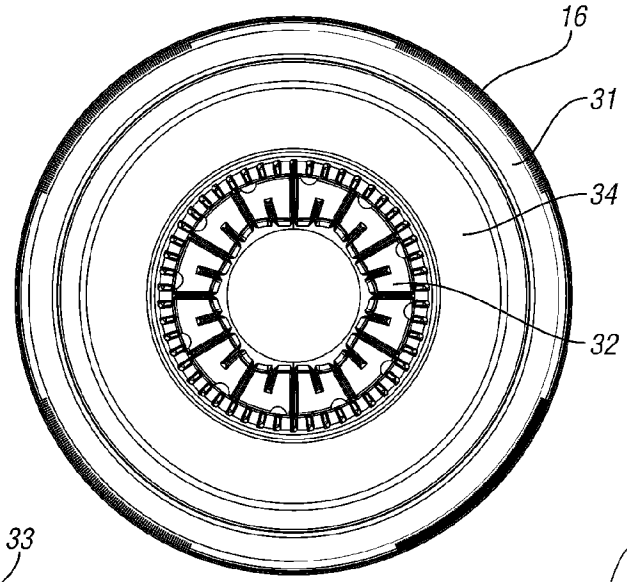
FIG. 11 is a top view of the lid of FIG. 1.
Figure 13:
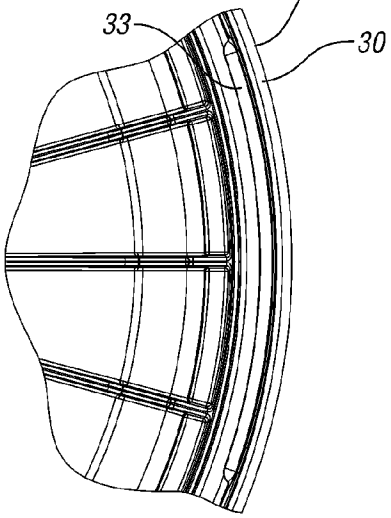
FIG. 13 is an enlarged view of an area of the lip of FIG. 12.
Figure 12:
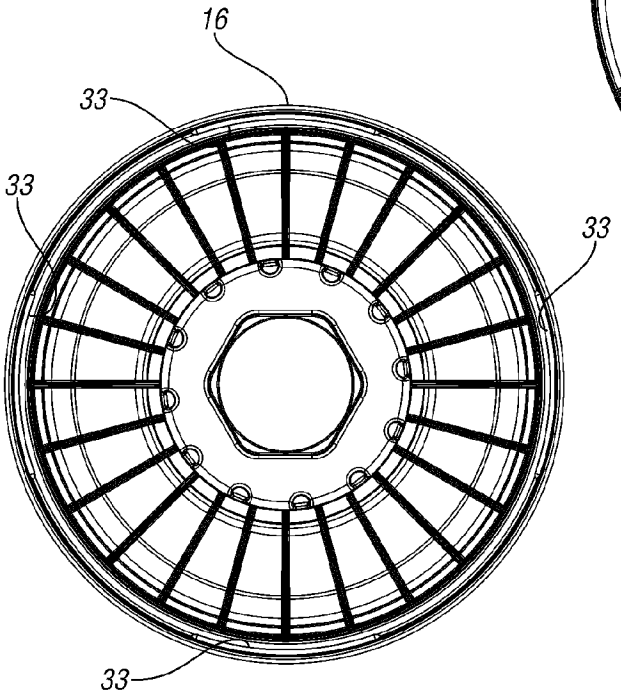
FIG. 12 is a bottom view of the lid of FIG. 11.
Figure 14:
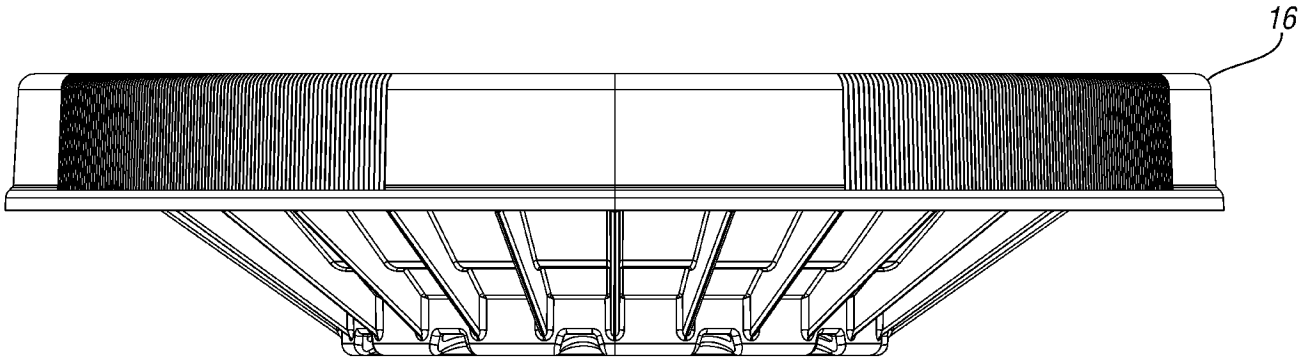
FIG. 14 is a side view of the lid.
Figure 15:
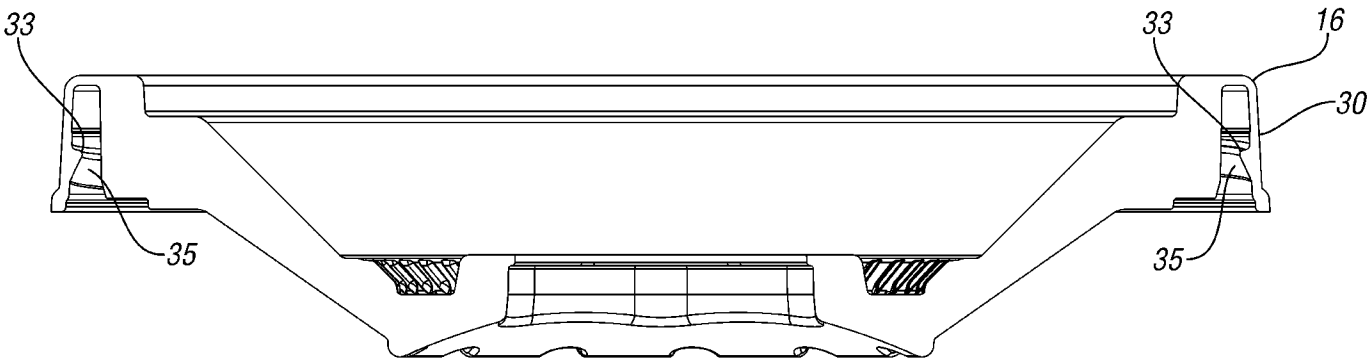
FIG. 15 is a section view through the lid.

FIG. 11 is a top view of the lid 16. FIG. 12 is a bottom view of the lid 16 and FIG. 13 is an enlarged view of an area of FIG. 12, showing one of the shoulders 33 projecting inwardly from the lip 30. FIG. 14 is a side view of the lid 16. FIG. 15 is a section view through the lid 16. As shown in FIG. 15, the shoulders 33 include an angled lower surface 35.

The lid 16 can be attached to the outer container 12 in either of two ways. First, with the shoulders 33 aligned with the locking ribs 27, the lid 16 is then pressed down until the locking ribs 27 bias the angled lower surfaces 35 of the shoulders 33 outward until the shoulders 33 snap down below the locking ribs 27, thereby locking the lid 16 to the container 12. Alternatively, the lid 16 can be placed on the container 12 with the shoulders 33 to the counter-clockwise position of the locking ribs 27. The lid 16 is then rotated clockwise so that the shoulder 33 moves under the locking rib 27 and the lid 16 is drawn down tight against the container 12. Alternatively, the lid 16 can be snapped-down and then rotated to tighten further. Upon rotation, the shoulders 33 may contact the stop rib 54, which prevents further rotation and keeps the lid 16 in placed locked to the locking rib 27. For removal, the lid 16 can be rotated counter-clockwise, thereby moving the shoulders 33 out from under the locking ribs 27.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, the lid 16 could be configured to tighten in the opposite direction (counter-clockwise). More or fewer locking ribs 27 and shoulders 33 could be provided to connect the lid 16 to the container 12.

What is claimed is:

1. A plastic beer keg including:

a lid having an opening, the lid having a lip extending downward at a periphery thereof, the lip including a lower end having a diameter and an inner surface angled upward and inward from the lower end to a shoulder;

a liner including a neck portion and a body portion, the neck portion adjacent the opening in the lid;

an outer container having a wall with at least one locking rib projecting therefrom, the locking rib angling downward along a circumference of the outer container, the lid secured to the outer container by the at least one locking rib, wherein the at least one locking rib has an outer diameter not greater than the diameter of the lower end of the lip of the lid, such that the lid can be snapped onto the locking rib and wherein the lid can be rotated to lock onto the locking rib.

2. The plastic beer keg of claim 1 further including a valve assembly within the neck portion of the liner.

3. The plastic beer keg of claim 2 wherein the locking rib angles downward to a stop rib that extends downward past the locking rib.

4. The plastic beer keg of claim 3 wherein the at least one locking rib includes a plurality of locking ribs spaced about a circumference of the outer container.

5. The plastic beer keg of claim 4 wherein the lid can be snapped onto the locking rib.

6. The plastic beer keg of claim 5 wherein the lid can be rotated to lock onto the locking rib.

7. The plastic beer keg of claim 1 wherein the locking rib angles downward to a stop rib that extends downward past the locking rib.

8. The plastic beer keg of claim 1 wherein the at least one locking rib includes a plurality of locking ribs spaced about a circumference of the outer container.

9. The plastic beer keg of claim 8 wherein the locking rib angles downward to a stop rib that extends downward past the locking rib.

10. A plastic beer keg including:

a lid having an opening, the lid having a lip extending downward at a periphery thereof, the lip including an inner surface angled upward and inward;

a liner including a neck portion and a body portion, the neck portion adjacent the opening in the lid;

an outer container having a wall with a plurality of locking ribs projecting therefrom and spaced about a circumference of the outer container, the locking ribs angling downward, the lid secured to the outer container by the the plurality of locking ribs, wherein the inner surface of the lid can engage and snap past the plurality of locking ribs.

11. The plastic beer keg of claim 10 further including a valve assembly within the neck portion of the liner.

12. The plastic beer keg of claim 11 wherein the plurality of locking ribs each angle downward to a stop rib that extends downward past the locking rib.

13. The plastic beer keg of claim 10 wherein the lip has a lower end having a diameter greater than a diameter of the at least one locking rib.

14. The plastic beer keg of claim 13 wherein the inner surface is angled upward and inward from the lower end to a shoulder having a diameter less than the diameter of the at least one locking rib.

15. The plastic beer keg of claim 12 wherein the lid can be rotated to lock onto the plurality of locking ribs.

16. The plastic beer keg of claim 15 wherein the locking ribs angle downward along a circumference of the outer container.

* * * * *